US006910761B2

(12) United States Patent
Kondoh et al.

(10) Patent No.: US 6,910,761 B2
(45) Date of Patent: Jun. 28, 2005

(54) INK JET RECORDING HEAD AND INK JET RECORDING APPARATUS

(75) Inventors: Yoshinao Kondoh, Ebina (JP); Hiroyuki Usami, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 19 days.

(21) Appl. No.: 10/631,261

(22) Filed: Jul. 31, 2003

(65) Prior Publication Data

US 2004/0113989 A1 Jun. 17, 2004

(30) Foreign Application Priority Data

Dec. 11, 2002 (JP) ..... 2002-359728

(51) Int. Cl.[7] ..... B41J 2/05
(52) U.S. Cl. ..... 347/62; 347/56
(58) Field of Search ..... 347/20, 54, 56, 347/61, 63, 64, 65, 62, 67

(56) References Cited

U.S. PATENT DOCUMENTS 4,990,939 A * 2/1991 Sekiya et al. ..... 347/62

FOREIGN PATENT DOCUMENTS

JP A 10-230605 9/1998

* cited by examiner

*Primary Examiner*—Juanita D. Stephens
(74) *Attorney, Agent, or Firm*—Morgan Lewis & Bockius LLP

(57) ABSTRACT

There is provided an ink jet recording head which can efficiently prevent ink from corroding an insulating film layer. A positive electrode is disposed on an upper surface of the insulating film layer and a negative electrode is disposed on a lower surface of the insulating film layer, which is referred to as a turnover structure. There is no electrode between any two adjacent heater resistor portions. As a result, high-density disposition of the heater resistor portions can be carried out. The heater resistor portions are thermally oxidized, so that surfaces thereof are changed into tantalum insulating films (surface oxidation films), which serve as ink protection layers. A second insulating film layer is totally covered by the heater resistor portions and the partition walls and is not exposed. Thus, ink does not contact the second insulating film layer, and the second insulating film layer is not corroded by ink.

12 Claims, 5 Drawing Sheets

INK JET RECORDING HEAD AND INK JET RECORDING APPARATUS

CROSS-REFERENCE TO RELATED APPLICATION

This application claims priority under 35USC 119 from Japanese Patent Application No. 2002-359728, the disclosure of which is incorporated by reference herein.

BACKGROUND OF THE INVENTION

1. Field of the Invention

The present invention relates to an ink jet recording head and an ink jet recording apparatus.

2. Description of the Related Art

There is an ink jet recording system in which by rapidly vaporizing a predetermined amount of ink by heat, which heat is created by a heater resistor, an ink drop is then ejected from a orifice by such a resultant vapor bubble. In this system, the heater resistor tends to corrode due to the heat and the ink. In order to prevent this, an ink protection layer is interposed between the heater resistor and the ink. As a result of the ink protection layer, which covers the heater resistor, and through which the ink is heated, thermal conductivity with respect to the ink declines. In consideration of this defect, there is a measure in which a surface of a heater resistor is oxidized to form a surface oxidation film, and then, such a resultant surface oxidation film is utilized as an ink protection layer. This surface oxidation film is generally extremely thin, and thus, has good thermal conductivity with respect to the ink. An ink jet recording head is known, using heater resistors that are made from a material, such as TaSiO. Surfaces of the heater resistors are oxidized, so that such resultant oxidation surfaces each can serve as an ink protection layer (for example, refer to Japanese Patent Application Laid-Open (JP-A) No. 10-230605).

However, in a head structure in which heater resistors, each of which is made from, for example, TaSiO and has an oxidized surface layer serving as an ink protection layer, are used, major part of an insulating film layer is generally covered with the ink protection layers (or the oxidized surfaces) of the heater resistor and the remaining part or some part of the insulating film layer is not covered, i.e., it is exposed to the outside. The insulating film layer is ordinarily made from a silicon insulator, which is easily corroded by thermochemical reaction depending upon a composition of the ink. Therefore, some type of material to be used as the ink, which material does not corrode such a silicon insulator, must be selected from a limited number of such materials. As a result, the versatility of an ink jet recording head cannot be increased, so as to allow use of a wide variety of ink.

Further, to prevent the ink from corroding the silicon insulator, it is necessary to further provide an additional ink protection layer for covering the silicon insulator. In this case, as previously described, because the ink is heated purposely through this additional ink protection layer, thermal conductivity with respect to the ink declines.

SUMMARY OF THE INVENTION

In light of the above-described facts, a primary object of the present invention is to provide an ink jet recording head, which is simple in structure and easy to manufacture and which efficiently prevents ink from corroding an insulating film layer without further providing an additional ink protection layer.

Another object of the present invention is to provide an ink jet recording apparatus that can use ink, which is made from a large variety of materials.

In order to achieve the objects described above, according to an aspect of the present invention, there is provided an ink jet recording head for ejecting ink droplets to print an image, the print head comprising: a substrate; an insulating film layer disposed on the substrate; a plurality of partition walls for defining a plurality of bubbled-ink forming portions, the partition walls being disposed on the insulating film layer along a predetermined, first direction with a predetermined distance between them; a plurality of heater resistor portions disposed on the insulating film layer within the respective bubbled-ink forming portions, a surface of each heater resistor portion having an oxidation film which is formed by being thermally oxidized and which serves as an ink protection layer, each heater resistor portion being formed by a bubbled-ink forming area for heating and vaporizing ink and by extended portions which are connected to opposite ends, in the first direction, of the bubbled-ink forming area; and a plurality of pairs of electrodes, each pair of the electrodes being connected to a corresponding heater resistor portion, one electrode of each pair being a first electrode and being disposed at a lower surface side of the insulating film layer, the other electrode of each pair being a second electrode and being disposed on the heater resistor portion, wherein an upper surface of the insulating film layer is entirely covered with the partition walls and the heater resistor portions such that the upper surface of the insulating film layer is not in direct contact with ink.

According to another aspect of the present invention, there is provided an ink jet recording apparatus which is provided with an ink jet recording head for ejecting ink droplets to print an image, the ink jet recording head comprising: a substrate; an insulating film layer disposed on the substrate; a plurality of partition walls for defining a plurality of bubbled-ink forming portions, the partition walls being disposed on the insulating film layer along a predetermined, first direction with a predetermined distance between them; a plurality of heater resistor portions disposed on the insulating film layer within the respective bubbled-ink forming portions, a surface of each heater resistor portion having an oxidation film which is formed by being thermally oxidized and which serves as an ink protection layer, each heater resistor portion being formed by a bubbled-ink forming area for heating and vaporizing ink and by extended portions which are connected to opposite ends, in the first direction, of the bubbled-ink forming area; a plurality of pairs of electrodes, each pair of the electrodes being connected to a corresponding heater resistor portion, one electrode of each pair being a first electrode and being disposed at a lower surface side of the insulating film layer, the other electrode of each pair being a second electrode and being disposed on the heater resistor portion, the second electrode including a first terminal and a second terminal, between which the bubbled-ink forming area is positioned when viewed in top plan view, the first terminal being electrically connected to the first electrode; and an ejection nozzle including a plurality of nozzles at positions corresponding to the plurality of heater resistor portions, wherein an upper surface of the insulating film layer is entirely covered with the partition walls and the heater resistor portions such that the upper surface of the insulating film layer is not in direct contact with ink.

The foregoing and other objects, features and advantages of the present invention will be apparent from the following description of preferred embodiments of the invention, as illustrated in the accompanying drawings.

DESCRIPTION OF THE PREFERRED EMBODIMENT

Figure 1:
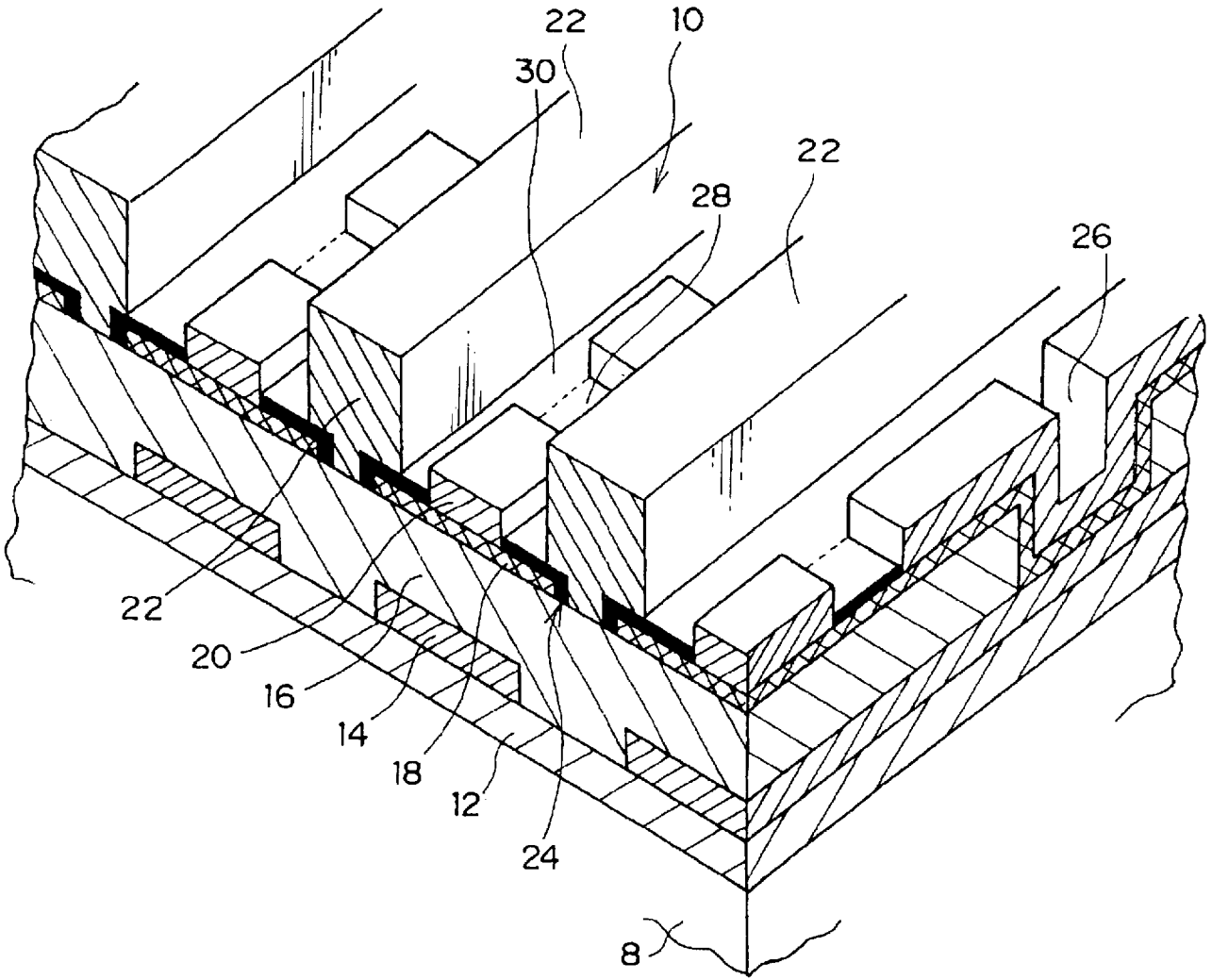
FIG. 1 is a perspective sectional view showing part of an ink jet recording head according to a first embodiment of the invention.

An ink jet recording head according to a first embodiment of the present invention will be described in detail below on the basis of FIGS. 1, 2A, 2B, 3A and 3B.

The ink jet recording head includes a substrate 8, a first insulating film layer 12 and a second insulating film layer 16, which are disposed in this order. Between the first insulating film layer 12 and the second insulating film layer 16 are provided first electrode layer portions 14, which are separated from one another and disposed at predetermined intervals in a predefined first direction. Heater resistor portions 18, which are provided in the same manner as the first electrode layer portions 14, are disposed on the second insulating film layer 16. Second electrode layer portions 20 are spaced apart from one another and respectively disposed on the heater resistor portions 18. Partition walls 22 are each provided between two of the second electrode layer portions 20 in the first direction. Non-illustrated nozzles serving as ink discharge openings are spaced apart from one another and disposed in the first direction.

The first electrode layer portions 14, which are formed from aluminum, serve as negative poles. The second insulating film layer 16 is formed from a silicone oxide film. Dimensions (or film thicknesses) at portions thereof between the first electrode layer portions 14 and the heater resistor portions 18 are approximately 1 to 2 m.

The heater resistor portions 18, which are formed from TaSiO through sputtering processing or the like, have thicknesses of approximately 0.1 m. The heater resistor portions 18 are thermally oxidized, so that surfaces thereof are changed into tantalum insulating films (surface oxidation films) 24. The tantalum insulating films 24 have sufficient mechanical strength and corrosion resistance to serve as ink protection layers. They are very thin and have thicknesses of about 0.01 m and good thermal conductivity with respect to ink. The thermal oxidization for forming the tantalum insulating films 24 is carried out at a temperature of about 400° C. after the second electrode layer portions are formed, so that other materials on the substrate, e.g., the first electrode layer portions 14 are not adversely affected.

As the second electrode layer portions 20 are directly contacted with ink, they are formed of a metal material having a relatively small resistivity and excellent corrosion resistance to ink. For example, they are formed by sputtering or plating of Ni, Au or the like.

The partition walls 22 are spaced apart to provide bubbled-ink forming portions 10 therebetween. In each of the bubbled-ink forming portions 10, a pair of terminals 20*a* and 20*b*, which form the second electrode layer portion 20, are opposed to each other, between which a rectangular-shaped part of the heater resistor portion 18 is positioned, said rectangular-shaped part constituting a bubbled-ink forming area 28. One of the terminals 20*a* (left hand side in FIG. 2B) is connected via a through-hole 26 to the first electrode layer portion 14, which is a negative electrode, and the other terminal 20*b* is a positive electrode. Thus, a so-called turnover structure is formed in which a positive electrode is disposed on an upper surface of a insulating film layer and a negative electrode is disposed on a lower surface of the insulating film layer.

There is no electrode between any two adjacent heater resistor portions 18. Each of the heater resistor portions 18 is heated by applying pulsed electric current, which flows from the positive electrode (20*b*) to the negative electrode (20*a*).

Figure 3A:
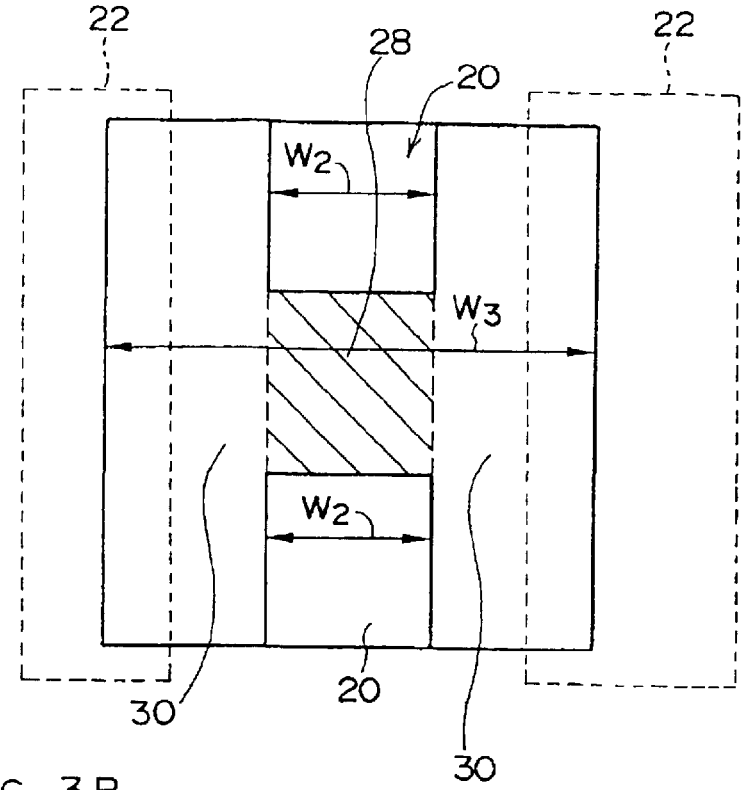
FIG. 3A is a partial plan view of the head part of FIG. 1.

In each of the bubbled-ink forming portions 10, as shown in FIG. 3A, the heater resistor portion 18 includes the bubbled-ink forming area 28, which has the same width as the second electrode layer portion 20 (forming the terminal pair 20*a* and 20*b*), and extended portions 30, which are symmetrically disposed about and connected to the bubbled-ink forming area 28 when seen from above (see FIG. 3A). The extended portions 30 and the partition walls 22 are partly overlapped as seen from above.

Namely, each of the partition walls 22 is disposed in straddling relation to two adjacent extended portions 30. Spaces each defined by two of the partition walls 22 and one heater resistor portion 18 between the two serve as the bubble-ink forming portions 10. Incidentally, because the extended portions 30 do not reach a high temperature and do not contribute to the above-noted bubble formation due to a reason described below, it is unnecessary to use high heat resistant resin as a material constituting the partition walls 22.

The second insulating film layer 16 is totally covered by the heater resistor portions 18 and the partition walls 22 and is not exposed. Thus, the ink does not contact the second insulating film layer 16, and the second insulating film layer 16 is not corroded by the ink.

When the surface of the second insulating film layer 16 is uneven, the surfaces of the heater resistor portions 18 reflect such an uneven surface and are correspondingly uneven. Due to such unevenness of the surfaces, lives of the heater resistor portions 18 are shortened. In consideration thereof, it is preferable that at least face portions, which contact the heater resistor portions 18, of the second insulating film layer 16 are made flat and smooth by using, for example, a known method which is employed in a conventional LSI manufacturing process. If the surface of the second insulating film layer 16 is made even, the surfaces of the heater resistor portions 18 become even, and lives thereof can be lengthened.

Figure 2A:
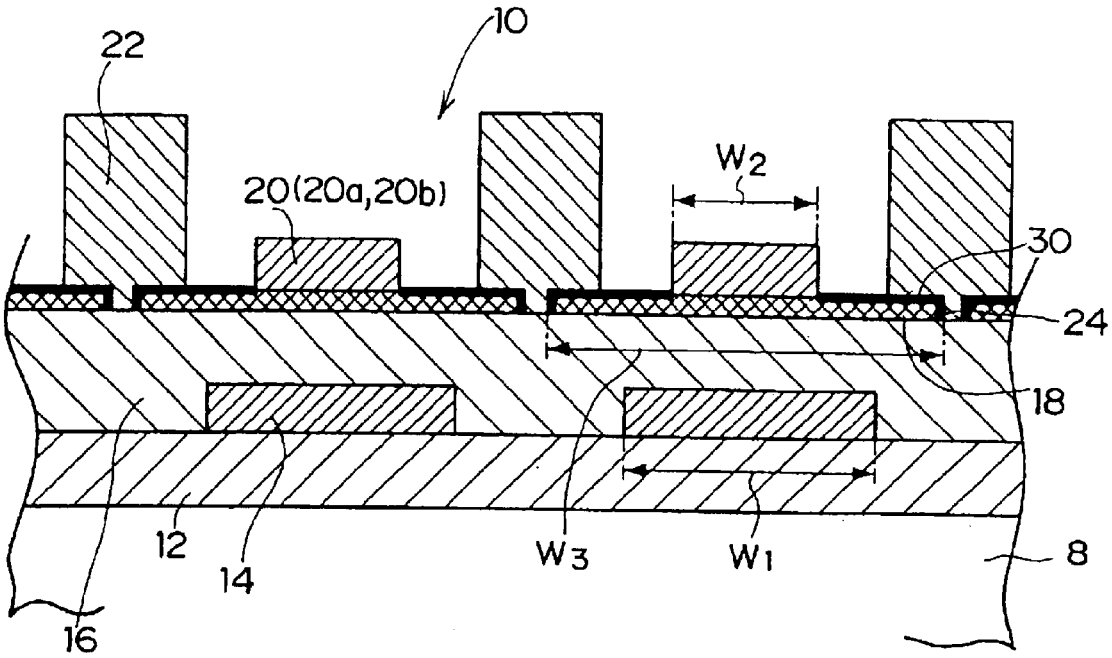
FIG. 2A is a sectional view of the head part of FIG. 1 viewed in a direction perpendicular to a direction in which heater resistor portions are disposed.
Figure 2B:
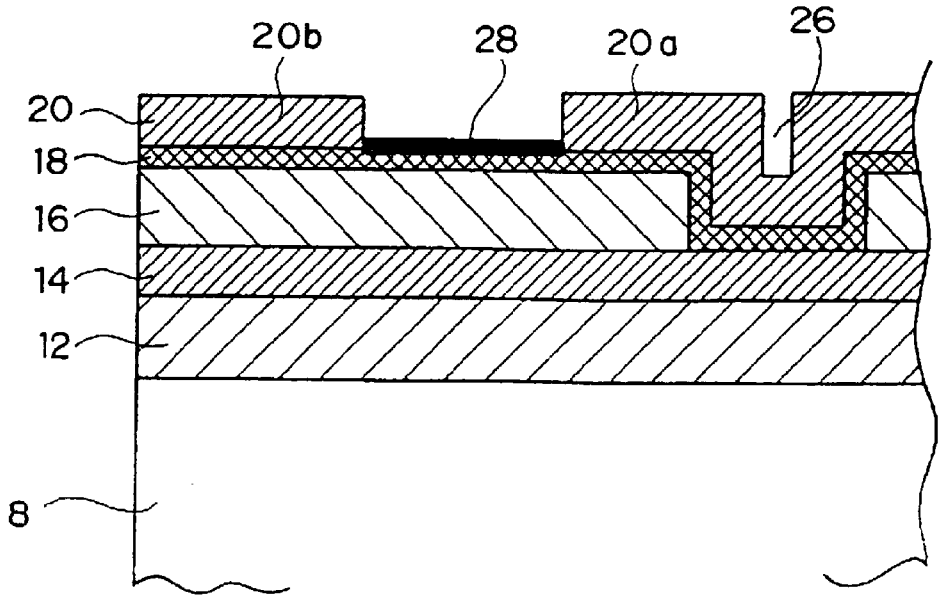
FIG. 2B is a sectional view of the head part of FIG. 1 viewed in the direction in which the heater resistor portions are disposed.

Further, as shown in FIG. 2A, a relation of W2<W1<W3 is set where the width of the first electrode layer portion 14 is W1, the width of the second electrode layer portion 20 is W2, and the width of the heater resistor portion 18 (which includes the extended portions 30) is W3.

Due to this structure, the following operation and effects are obtained. Specifically, when the second insulating film layer 16 is formed over the first electrode layer portions 14, a stepped or undulating surface of the second insulating film layer 16 is formed, representing presence and absence of the first electrode layer portions 14. In each of the bubbled-ink forming areas 28, the surface of the heater resistor portion 18 is affected by such an uneven surface of the second insulating film layer 16 and becomes likewise uneven. The life of the heater resistor portion 18 is thereby shortened. However, because the width W2 of the second electrode layer portion 20 is narrower than the width W1 of the first electrode layer portion 14, no noticeable surface unevenness at the bubbled-ink forming area 28 of the heater resistor portion 18 is generated. Thus, in each bubbled-ink forming area 28, the surface of the heater resistor portion 18 can be substantially flat even if the surface of the second insulating film layer 16 is not flat. Accordingly, the life of the heater resistor portion 18 can be extended. Further, because intervals between the heater resistor portions 18 depend on the widths of the heater resistor portions 18, high-density disposition of the heater resistor portions 18 can be carried out.

For example, in a case in which the ink jet recording head has 600 dpi resolution, intervals between the heater resistor portions 18 in the above-described first direction are about 42 m. In this case, it is preferable that the width W3 of the heater resistor portion 18 including the extended portions 30 is about 38 m, that the width W1 of the first electrode layer portion 14 is about 32 m, that the width W2 of the second electrode layer portion 20 is about 26 m, and that the width or a length, in the above-noted first direction, of a part of the extended portion 30 that is overlapped with or covered by the partition wall 22 is about 3 m or more.

Figure 3B:
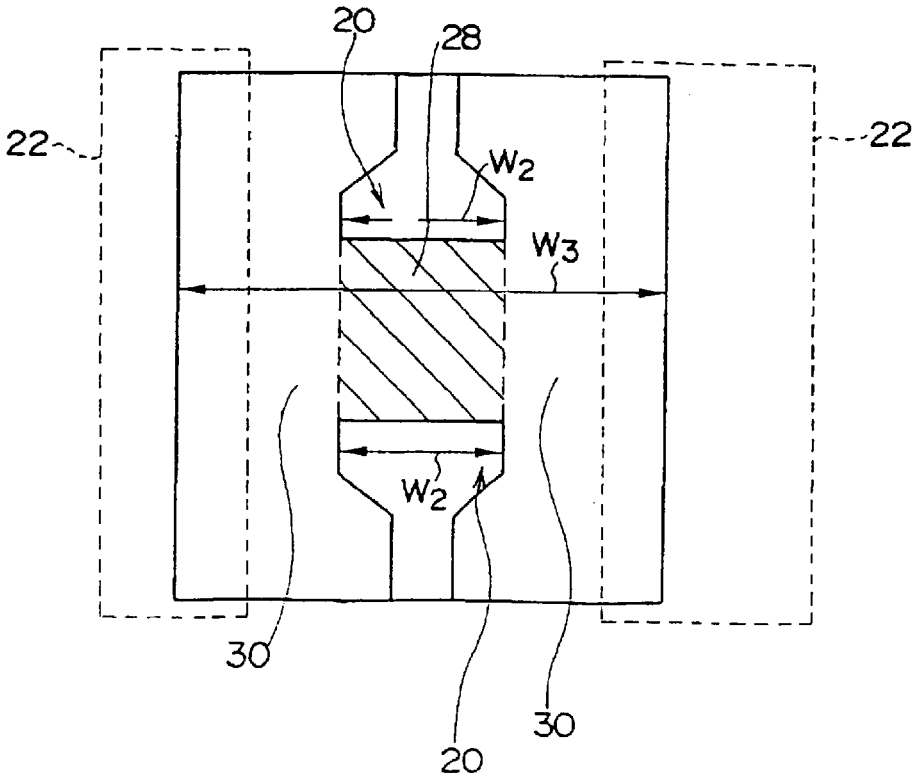
FIG. 3B is a view similar to FIG. 3A of another example of the head part.

Further, each of the terminal pairs formed by the second electrode layer portions 20 can be of any shape, when seen from above. Shapes such as in the embodiments shown in FIGS. 3A and 3B are preferable. If terminals of each terminal pair have tapered parts (parts thickened toward ends), a width of each of which gradually increases or diverges towards the other tapered part, it is preferable in view of manufacturing that each tapered part presents an obtuse angle at the boundary thereof, as shown in FIG. 3B.

The width W2 of the second electrode layer portion 20 corresponds to the width of connection between each of the terminals 20*a* and 20*b* and the heater resistor portion 18 (see FIGS. 3A and 3B).

Operation of the above-described first embodiment will be described below.

The bubbled-ink forming portion 10 is filled with ink, which has been introduced through an ink inlet opening (not illustrated). Pulsed electric current, which is applied, flows from the positive electrode (20*b*) to the negative electrode (20*a*), so that the bubbled-ink forming area 28 of the heater resistor portion 18 is instantaneously heated to a high temperature. A certain amount of ink positioned at the bubbled-ink forming area 28 is vaporized by heat of the heater resistor portion 18 into a vapor bubble. The vapor bubble expands, and force of the expanding vapor bubble in a direction perpendicular to the surface of the bubbled-ink forming area 28 of the heater resistor portion 18 ejects ink through the corresponding non-illustrated nozzle. For the following reasons, the extended portions 30 at both sides of the heater resistor portion 18 are not heated to a high temperature, and thus, do not contribute to such a vapor bubble formation.

Therefore, although the ink protection layers are the surface oxidation films of the heater resistor portions 18, it is possible to prevent corrosion of the second insulating film layer 16 by ink without adding any further ink protection layers. As a result, a variety of ink materials can be used and an ink jet recording head and an ink jet recording apparatus, with high versatility, can be provided.

Now, detailed description will be given of the reason why the extended portions 30 do not reach high temperatures.

Even though each of the heater resistor portions 18 totally and evenly generates heat, heat tends to be conducted and dissipated to the outside at a peripheral part of the heater resistor portion, whereby the temperature of this peripheral part is lower than that of a central part of the heater resistor portion. The tantalum insulating films 24 are extremely thin and have high thermal conductivity with respect to ink, and therefore, the above-described tendency is increased. Thus, the extended portions 30 of the heater resistor portion 18 do not reach a higher temperature than the rectangular-shaped part of the heater resistor portion 18.

Further, when the heater resistor portion 18 has pulsed electric current applied thereto to generate heat, the current, which flows through the heater resistor portion 18, takes the shortest route between the two terminals due to extremely high electrical current density. The extended portions 30 of the heater resistor portion 18 have low electrical current density distribution. Therefore, the rectangular-shaped part, which constitutes the bubbled-ink forming area 28, of the heater resistor portion 18 easily reach a high temperature, whereas the extended portions 30 do not easily reach a high temperature.

Furthermore, TaSiO has a negative (resistance) temperature coefficient. When the rectangular-shaped part of the heater resistor portion, which constitutes the bubbled-ink forming area 28, is heated to a high temperature, a value of electrical resistance of the rectangular-shaped part decreases and an amount of electrical current flowing therethrough becomes large, as compared to the extended portions 30. As just described, the rectangular-shaped part, which constitutes a bubbled-ink forming area 28, of the heater resistor portion 18 easily reaches a high temperature, whereas the extended portions 30 are maintained at a low predefined temperature.

As a multiplier effect of the above-described facts, the extended portions 30 of the heater resistor portion 18 do not reach a high temperature, and do not contribute to formation of ink bubbles. Thus, the partition walls are not adversely affected.

In practice, the inventors have conducted reliability testing for an ink jet recording head according to the present invention. In this testing, only the rectangular-shaped part of the heater resistor portion 18 has had troubles based on either wear-out failure or overcurrent failure, though the number of occurences of such troubles are small, whereas the extended portions 30 have had no trouble.

Figure 4A:
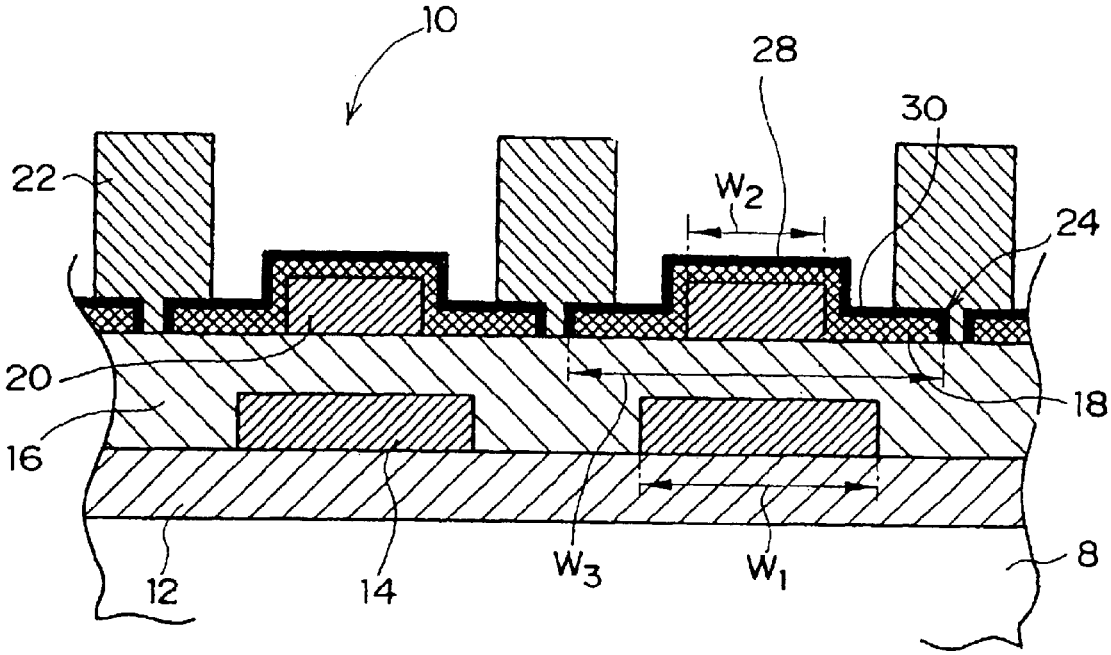
FIG. 4A is a partial sectional view of an ink jet recording head according to a second embodiment of the invention, viewed in a direction perpendicular to a direction in which heater resistor portions are disposed.
Figure 4B:
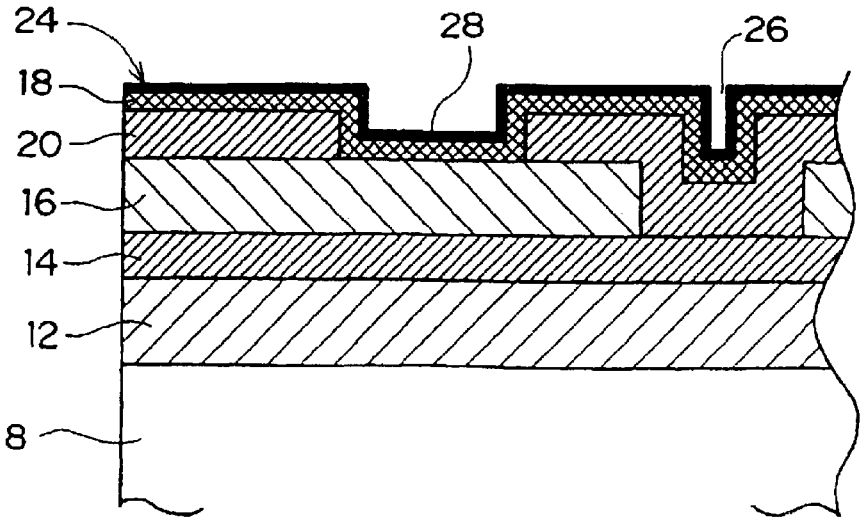
FIG. 4B is a partial sectional view of the head part of FIG. 4A viewed in the direction in which the heater resistor portions are disposed.

Next, with reference to FIGS. 4A and 4B, an ink jet recording head according to a second embodiment of the present invention will be described. FIGS. 4A and 4B are similar to FIGS. 2A and 2B, respectively. Components which are the same as those explained in the first embodiment are denoted by the same reference numerals, and redundant explanation will be omitted where appropriate.

The structure of the second embodiment is similar to that of the first embodiment except in that the heater resistor portions 18 are formed on top surfaces of the second electrode layer portions 20. In other words, the second electrode layer portions 20 and the heater resistor portions 18 are formed and laminated in this order.

Operation of the ink jet recording head according to the second embodiment will be described below.

The ink jet recording head of the second embodiment operates in the same manner as the ink jet recording head of the first embodiment. However, in the second embodiment, upper and side surfaces of each of the second electrode layer portions 20 are fully covered by the heater resistor portions 18 such that the second electrode layer portions 20 do not contact the ink. The second electrode layer portions 20 can be made of aluminum, which is not corrosion-resistant to ink. As compared to Ni and Au, Al is a low-cost material and has good workability as well. Thus, production cost can be reduced. Further, because the ink jet recording head does not use harmful materials such as Ni, it is environmentally friendly.

Next, with reference to FIGS. 5A and 5B, an ink jet recording head according to a third embodiment of the present invention will be described. Elements which are the same as those explained in the first and the second embodiments are denoted by the same reference numerals, and redundant explanations will be omitted where appropriate.

The structure of the third embodiment is similar to those of the first and the second embodiments, except in that the second insulating film layer 16 comprises two second insulating film layers 16A and 16B, and in that a third electrode layer portion 32 is formed between the first electrode layer portion 14 and the heater resistor portion 18.

Figure 5A:
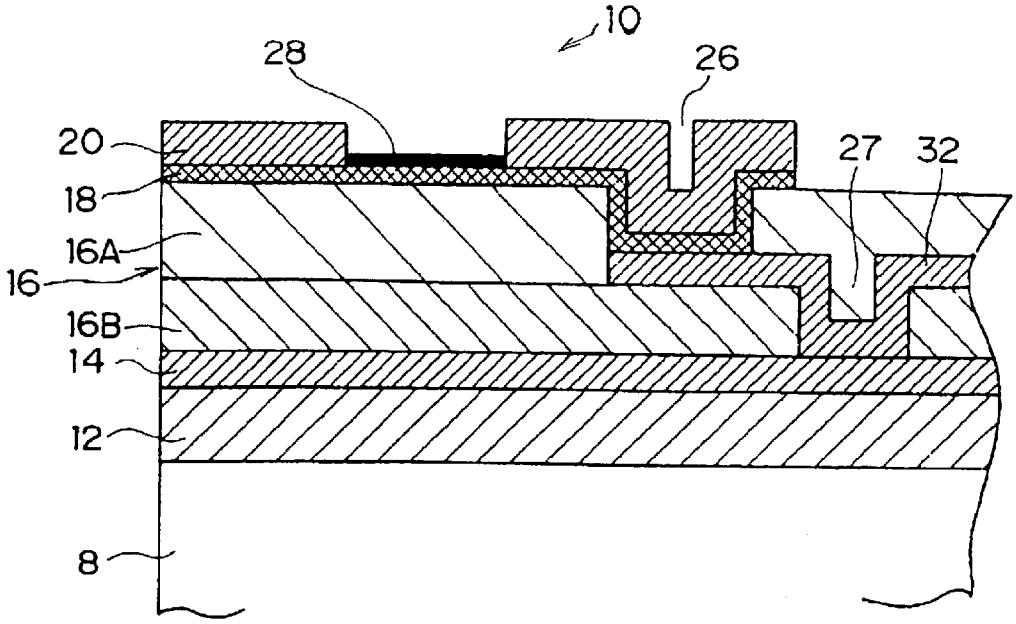
FIG. 5A is a partial sectional view of an ink jet recording head according to a third embodiment of the invention, viewed in a direction in which heater resistor portions are disposed.
Figure 5B:
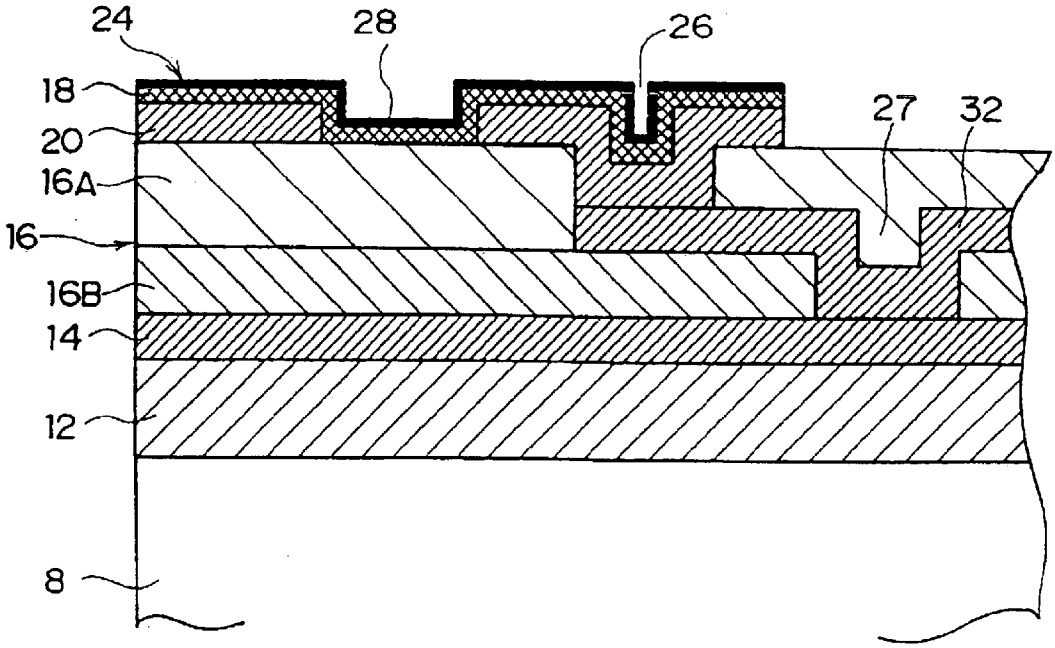
FIG. 5B is a view similar to FIG. 5A of another example of the head part of FIG. 5A.

FIG. 5A is a cross sectional view showing a bubbled-ink forming portion 10 of the third embodiment in which one second insulating film layer 16A is formed between the heater resistor portion 18 and the third electrode layer portion 32 and the other second insulating film layer 16B is formed between the third electrode layer portion 32 and the first electrode layer portion 14. FIG. 5B is a cross sectional view showing a variant example of the bubbled-ink forming portion 10 of the third embodiment in which the one second insulating film layer 16A is formed between the second electrode layer portion 20 and the third electrode layer portion 32 and the other second insulating film layer 16B is formed between the third electrode layer portion 32 and the first electrode layer portion 14.

As described above, the second insulating film layer 16 comprises the two insulating film layers 16A and 16B. Since the second insulating film layer 16 tends to be relatively thick, there is a case in which connection between the second electrode layer portion 20 and the first electrode layer portion 14 cannot be implemented through only one through-hole. In consideration thereof, the second electrode layer portion 20 and the third electrode layer portion 32 are connected through a through-hole 26 and the third electrode layer portion 32 and the first electrode layer portion 14 are connected through another through-hole 27. Namely, the second electrode layer portion 20 and the first electrode layer portion 14 are connected through the third electrode layer portion 32.

Next operation of the ink jet recording head according to the third embodiment will be described.

The ink jet recording head of the third embodiment operates in a manner similar to those of the first and the second embodiment. However, in the third embodiment, because the second insulating film layer 16, which comprises the two insulating film layers 16A and 16B, is relatively thick, it is difficult for the heat of the heater resistor portion 18 to be transmitted to the first electrode layer portion 14, which is made of Aluminum which has good thermal conductivity. Thus, the efficiency of thermal conductivity with respect to the ink can be improved Note that the present invention is not limited to the embodiments described above.

For example, in the embodiment described above, the heater resistor portions 18, which have the surface oxidation films each serving as an ink protection layer, are formed from TaSiO. However, the present invention is not limited to such a configuration. Any other materials, whose surface oxidation film can serve as an ink protection layer, can be used. For example, CrSiO or the like is usable.

Further, in the embodiment described above, the second electrode layer 20 is an single layer. However, the present invention is not limited to such a configuration. The second electrode layer can be formed as a laminated structure comprising a plurality of layers.

Still further, in the embodiment described above, each end of the extended portions 30 has a linear shape. However, the present invention is not limited to such a configuration. If at least part of each of the extended portions is covered by an associated partition wall, an objective insulating film layer is covered by the partition walls and the extended portions, and this objective insulating film layer is not exposed to the outside, then the ends of the extended portions may have any appropriate shape.

Furthermore, in the embodiments described above, the first electrode layer portions 14 are negative and one end terminals of the terminal pairs constituting the second electrode layer portions 20 are positive. However, the invention is not limited to such a configuration. The first electrode layer portions can be positive and the one end terminals of the terminal pairs of the second electrode layer portions 20 can be negative.

Moreover, in the embodiments described above, one terminal of the terminal pair is connected to the first electrode layer portion 14 through the through-hole 26. However, the present invention is not limited to such a configuration. Any other appropriate structure in which electrodes are not provided between adjacent heater resistor portions can be employed.

It is to be understood that the present invention is by no means limited to the specific embodiments as illustrated and described herein, and that various modifications thereof may be made which fall within the scope of the present invention as defined in the appended claims.

What is claimed is:

1. An ink jet recording head for ejecting ink droplets to print an image, the print head comprising:

a substrate;

an insulating film layer disposed on the substrate;

a plurality of partition walls for defining a plurality of bubbled-ink forming portions, the partition walls being disposed on the insulating film layer along a predetermined, first direction with a predetermined distance between them;

a plurality of heater resistor portions disposed on the insulating film layer within the respective bubbled-ink forming portions, each heater resistor portion being formed by a bubbled-ink forming area for heating and vaporizing ink and by extended portions which are connected to opposite ends, in the first direction, of the bubbled-ink forming area;

a surface of each heater resistor portion having an oxidation film which is formed by being thermally oxidized and which serves as an ink protection layer; and a plurality of pairs of electrodes, each pair of the electrodes being connected to a corresponding heater resistor portion, one electrode of each pair being a first electrode and being disposed at a lower surface side of the insulating film layer, the other electrode of each pair being a second electrode and being disposed on the heater resistor portion, wherein an upper surface of the insulating film layer is entirely covered with the partition walls and the heater resistor portions such that the upper surface of the insulating film layer is not in direct contact with ink.

2. The ink jet recording head according to claim 1, wherein at least upper surface portions of the insulating film layer, on which upper surface portions the heater resistor portions are disposed, are flat.

3. The ink jet recording head according to claim 1, wherein the second electrode includes a first terminal and a second terminal, between which the bubbled-ink forming area is positioned when viewed in top plan view, the first terminal being electrically connected to the first electrode.

4. The ink jet recording head according to claim 1, wherein, if the width or length, in the first direction, of each of the first electrodes disposed at the lower surface side of the insulating film layer is defined as WI, the width or length, in the first direction, of the second electrode disposed on the heater resistor portions is defined as W2, and the width or length, in the first direction, of the heater resistor portion is defined as W3, then W2<W1<W3.

5. The ink jet recording head according to claim 1, wherein the heater resistor portions are formed from TaSiO.

6. The ink jet recording head according to claim 1, further comprising an ejection nozzle including a plurality of nozzles at positions corresponding to the plurality of heater resistor portions.

7. The ink jet recording head according to claim 1, wherein each of the bubbled-ink forming areas is of rectangular shape when viewed in top plan view.

8. The ink jet recording head according to claim 1, wherein within each of the bubbled-ink forming portions, the first terminal and the second terminal are separated from one another in a direction substantially perpendicular to the first direction.

9. The ink jet recording head according to claim 1, wherein each of the first electrode is negative and each of the second electrode is positive.

10. The ink jet recording head according to claim 1, further comprising another insulating film layer, which is disposed between the insulating film layer and the substrate.

11. The ink jet recording head according to claim 10, wherein the first electrodes are disposed between the insulating film layer and the another insulating film layer.

12. An ink jet recording apparatus which is provided with an ink jet recording head for ejecting ink droplets to print an image, the ink jet recording head comprising:

a substrate;

an insulating film layer disposed on the substrate;

a plurality of partition walls for defining a plurality of bubbled-ink forming portions, the partition walls being disposed on the insulating film layer along a predetermined, first direction with a predetermined distance between them;

a plurality of heater resistor portions disposed on the insulating film layer within the respective bubbled-ink forming portions, a surface of each heater resistor portion having an oxidation film which is formed by being thermally oxidized and which serves as an ink protection layer, each heater resistor portion being formed by a bubbled-ink forming area for heating and vaporizing ink and by extended portions which are connected to opposite ends, in the first direction, of the bubbled-ink forming area;

a plurality of pairs of electrodes, each pair of the electrodes being connected to a corresponding heater resistor portion, one electrode of each pair being a first electrode and being disposed at a lower surface side of the insulating film layer, the other electrode of each pair being a second electrode and being disposed on the heater resistor portion, the second electrode including a first terminal and a second terminal, between which the bubbled-ink forming area is positioned when viewed in top plan view, the first terminal being electrically connected to the first electrode; and an ejection nozzle including a plurality of nozzles at positions corresponding to the plurality of heater resistor portions, wherein an upper surface of the insulating film layer is entirely covered with the partition walls and the heater resistor portions such that the upper surface of the insulating film layer is not in direct contact with ink.

* * * * *